US010166172B2

(12) United States Patent
Rhodes et al.

(10) Patent No.: US 10,166,172 B2
(45) Date of Patent: Jan. 1, 2019

(54) DUAL CONFIGURATION BOTTLE ASSEMBLY

(71) Applicant: Handi-Craft Company, St. Louis, MO (US)

(72) Inventors: Scott Rhodes, St. Louis, MO (US); Bernard J. Kemper, Bonne Terre, MO (US); Charles H. Miller, Barnhart, MO (US)

(73) Assignee: HANDI-CRAFT COMPANY, St. Louis, MO (US)

( * ) Notice: Subject to any disclaimer, the term of this patent is extended or adjusted under 35 U.S.C. 154(b) by 742 days.

(21) Appl. No.: 14/323,220

(22) Filed: Jul. 3, 2014

(65) Prior Publication Data

US 2015/0014268 A1 Jan. 15, 2015

Related U.S. Application Data

(60) Provisional application No. 61/844,557, filed on Jul. 10, 2013.

(51) Int. Cl.
*A61J 9/04* (2006.01)
*A61J 9/00* (2006.01)

(52) U.S. Cl.
CPC ..... *A61J 9/04* (2013.01); *A61J 9/006* (2013.01)

(58) Field of Classification Search
CPC ..... A61J 9/04; A61J 9/00; A61J 11/02; A61J 11/045; A61J 11/04
(Continued)

(56) References Cited

U.S. PATENT DOCUMENTS 2,822,102 A * 2/1958 Holland ..... A61J 11/02 215/11.1
2,892,559 A 6/1959 Raiche
(Continued)

FOREIGN PATENT DOCUMENTS

CL 200200498 2/2003
CL 200202506 1/2004
(Continued)

OTHER PUBLICATIONS

International Search Report and Written Opinion for PCT/US14/45842, dated Nov. 7, 2014, 10 pages.
(Continued)

*Primary Examiner* — Fenn C Mathew
*Assistant Examiner* — Cynthia Collado
(74) *Attorney, Agent, or Firm* — Armstrong Teasdale LLP

(57) ABSTRACT

A bottle assembly includes a container and a vent assembly positionable at least in part of a rim of the container. A collar assembly generally defines a closure for the container and is releasably engaged with a neck of the container. The collar assembly and the vent assembly are configured relative to one another to permit selective configuration between a first configuration and a second configuration. In the first configuration, the collar assembly urges the vent assembly onto the rim of the container such that at least a majority of a cross-section of a lateral vent of the vent assembly is disposed below the rim. In the second configuration, in which the vent assembly is omitted from the bottle assembly, the collar assembly substantially sealingly engages the rim of the container.

18 Claims, 9 Drawing Sheets

(58) Field of Classification Search
USPC ..... 215/11.5, 11.1, 11.4, 11.6; 222/464.4, 222/464.6
See application file for complete search history.

(56) References Cited

U.S. PATENT DOCUMENTS

| | | | | |
|---|---|---|---|---|
| 3,545,637 | A | 12/1970 | Barr | |
| 3,834,570 | A | 9/1974 | Barr | |
| 3,838,784 | A | 10/1974 | Barton | |
| 4,279,353 | A | 7/1981 | Honma | |
| 4,386,696 | A | 6/1983 | Goncalves | |
| 5,087,287 | A | 2/1992 | Holmes, III | |
| 5,101,992 | A | 4/1992 | Serre | |
| 5,172,821 | A | 12/1992 | Knopf | |
| 5,244,105 | A | 9/1993 | Serre | |
| 5,316,160 | A | 5/1994 | Cautereels | |
| 5,779,071 | A | 7/1998 | Brown et al. | |
| 5,791,503 | A | 8/1998 | Lyons | |
| 6,450,367 | B1 | 9/2002 | Sittler | |
| 6,543,632 | B1 | 4/2003 | McIntyre | |
| 7,743,952 | B2 | 6/2010 | Auer | |
| 7,828,165 | B2 | 11/2010 | Brown et al. | |
| 8,113,365 | B2 | 2/2012 | Brown et al. | |
| 8,146,759 | B2 | 4/2012 | Brown et al. | |
| 8,579,132 | B2 | 11/2013 | Wong | |
| 8,640,902 | B2 | 2/2014 | Tirosh et al. | |
| 2003/0183595 | A1* | 10/2003 | Huang | A61J 9/006 215/11.5 |
| 2003/0183596 | A1* | 10/2003 | Lombardo | A61J 9/04 215/11.5 |
| 2004/0089626 | A1* | 5/2004 | Pyun | A61J 9/006 215/11.5 |
| 2005/0236353 | A1* | 10/2005 | Hsu | A61J 9/006 215/11.5 |
| 2005/0258124 | A1 | 11/2005 | Brown | |
| 2006/0124573 | A1 | 6/2006 | Nachumi | |
| 2006/0213859 | A1 | 9/2006 | Sheu | |
| 2006/0243694 | A1 | 11/2006 | McKendry | |
| 2007/0262041 | A1 | 11/2007 | Smith | |
| 2008/0099422 | A1 | 5/2008 | Rees | |
| 2008/0173612 | A1 | 7/2008 | Renz | |
| 2008/0202950 | A1 | 8/2008 | Anderson | |
| 2008/0302793 | A1* | 12/2008 | Tirosh | A47G 19/2272 220/203.17 |
| 2009/0014403 | A1 | 1/2009 | Lu | |
| 2009/0071926 | A1 | 3/2009 | Berkovitch | |
| 2010/0038335 | A1* | 2/2010 | Liang | A61J 9/04 215/11.5 |
| 2010/0181277 | A1 | 7/2010 | Brown | |
| 2011/0000868 | A1 | 1/2011 | Brown et al. | |
| 2011/0068078 | A1* | 3/2011 | Brown | A61J 9/04 215/11.5 |
| 2011/0079570 | A1 | 4/2011 | Brown | |
| 2011/0309047 | A1 | 12/2011 | Fucito | |
| 2013/0048591 | A1 | 2/2013 | Morrone | |
| 2014/0190922 | A1 | 7/2014 | Rhodes | |

FOREIGN PATENT DOCUMENTS

| | | | |
|---|---|---|---|
| CN | 1054007 | A | 8/1991 |
| CN | 101262839 | A | 3/2012 |
| GB | 1070984 | A1 | 6/1967 |
| JP | 62-160940 | | 10/1987 |
| JP | 48-70992 | | 2/2012 |
| KR | 20070054575 | A | 5/2007 |
| TW | M296703 | U | 9/2006 |
| WO | 2006048878 | A1 | 5/2006 |
| WO | 2011095971 | A1 | 8/2011 |

OTHER PUBLICATIONS

Search Report (Translation) issued in connection with ROC (Taiwan) Patent Application No. 103123692, (dated Sep. 6, 2017).
Supplemental Partial European Search report for EP 14823026, dated Jan. 19, 2017, 4 pages.

* cited by examiner

DUAL CONFIGURATION BOTTLE ASSEMBLY

CROSS REFERENCE TO RELATED APPLICATIONS

This application claims the benefit of U.S. Provisional Patent Application No. 61/844,557 filed Jul. 10, 2013, which is hereby incorporated by reference in its entirety.

FIELD

The field of this invention relates generally to bottle assemblies and more particularly to a bottle assembly including a collar assembly and a vent assembly allowing configuration in at least two different assembled configurations.

BACKGROUND

Bottle assemblies, such as infant or nursing bottle assemblies, typically have multiple components including a bottle, a nipple, a collar for securing the nipple to the bottle (the nipple and collar sometimes collectively defining a collar assembly), and a cap for covering the nipple when the bottle is not in use. The nipple typically has one or more openings for allowing liquid contained within the bottle to exit through the nipple and into an infant's mouth for consumption by the infant (or young child). During use, the infant places an end of the nipple in their mouth and sucks on the nipple to withdraw the liquid contained within the bottle.

At least some bottle assemblies include a removable vent assembly that can be positioned within the bottle. For example, at least some bottle assemblies comprise a removable vent assembly configured to sit on an annular rim defining an open end of the bottle which permits venting of the bottle during use. Some examples of vented bottle assemblies include those available from Handi-Craft Company under the tradename Dr. Brown's. Additional examples are disclosed in U.S. Pat. No. 5,779,071 issued Jul. 14, 1998, U.S. Pat. No. 7,828,165 issued Nov. 9, 2010, U.S. Pat. No. 8,113,365 issued Feb. 14, 2012, and U.S. Pat. No. 8,146,759 issued Apr. 3, 2012, the disclosures of all of which are herein incorporated by reference in their entirety. In these bottle assemblies, the vent assembly allows air to enter the bottle while the infant consumes the liquid through the nipple, thus alleviating or reducing the formation of a vacuum within the bottle during nursing. The vent assembly typically seats, at least in part, on the rim of the bottle and a collar assembly including a collar and nipple are together threadably secured down over the vent assembly to external threads on the neck of the bottle.

Some users may at times assemble such a bottle with the vent assembly omitted from the bottle, such as when traveling or when a child is older and a parent decides to no longer use the vent assembly. In such an instance, the collar assembly is threaded onto the neck of the bottle until the collar is tightened down as much as possible. However, the neck of the bottle and the height of the collar are such that the collar assembly, and in particular the nipple of the collar assembly, do not adequately seal down against the rim of the bottle. As such, leakage of liquid from the bottle can occur.

There is a need, therefore, for a bottle assembly, and in particular a vented bottle assembly, in which the vent assembly can be removed and the bottle assembly still used without the risk of leakage.

SUMMARY

In one aspect, a bottle assembly generally comprises a container comprising an open end, a closed end, a base portion, a neck, and a rim on the neck of the container and defining the open end of the container, with the container having a central axis. A vent assembly is positionable at least in part on the rim of the container to permit venting of the container during use. The vent assembly comprises at least one lateral vent extending other than parallel to the central axis of the container when the vent assembly is positioned on the rim of the container. A collar assembly generally defines a closure for the container and is releasably engageable with the neck of the container over the open end thereof. The collar assembly and vent assembly are configured relative to each other to permit selective configuration of the bottle assembly between two configurations. In a first configuration, upon releasable engagement of the collar assembly with the neck of the container when the vent assembly is on the rim of the container, the collar assembly urges the vent assembly into substantially sealing engagement with the rim of the container such that at least a majority of a cross-section of the lateral vent is disposed below the rim. In a second configuration, upon releasable engagement of the collar assembly with the neck of the container when the vent assembly is omitted from the bottle assembly, the collar assembly substantially sealingly engages the rim of the container.

In another aspect, a vent insert for a bottle assembly generally comprises an annular outer portion having a central axis, and a lateral vent extending other than parallel to the central axis of the annular outer portion. The vent insert is configured to be positionable at least in part on a rim of a container to permit venting of the container during use. At least a majority of a cross-section of the lateral vent is disposed below the annular outer portion.

In yet another aspect, a bottle assembly generally comprises a container comprising an open end, a closed end, a neck, and a rim on the neck defining the open end of the container. A vent assembly is positionable at least in part on the rim of the container to permit venting of the container during use. A collar assembly generally defines a closure for the container and is releasably engageable with the neck of the container over the open end thereof. The collar assembly and the vent assembly are configured relative to each other to permit selective configuration of the bottle assembly between two configurations. In the first configuration, upon releasable engagement of the collar assembly with the neck of the container when the vent assembly is on the rim of the container, the collar assembly urges the vent assembly into substantially sealing engagement with the rim of the container. In the second configuration, upon releasable engagement of the collar assembly with the neck of the container when the vent assembly is omitted from the bottle assembly, the collar assembly substantially sealingly engages the rim of the container. The container of bottle assembly is configured to be vented in both the first configuration and the second configuration.

BRIEF DESCRIPTION OF THE DRAWINGS

Corresponding reference characters indicate corresponding parts throughout the several views of the drawings.

DETAILED DESCRIPTION OF THE DRAWINGS

Figure 1:
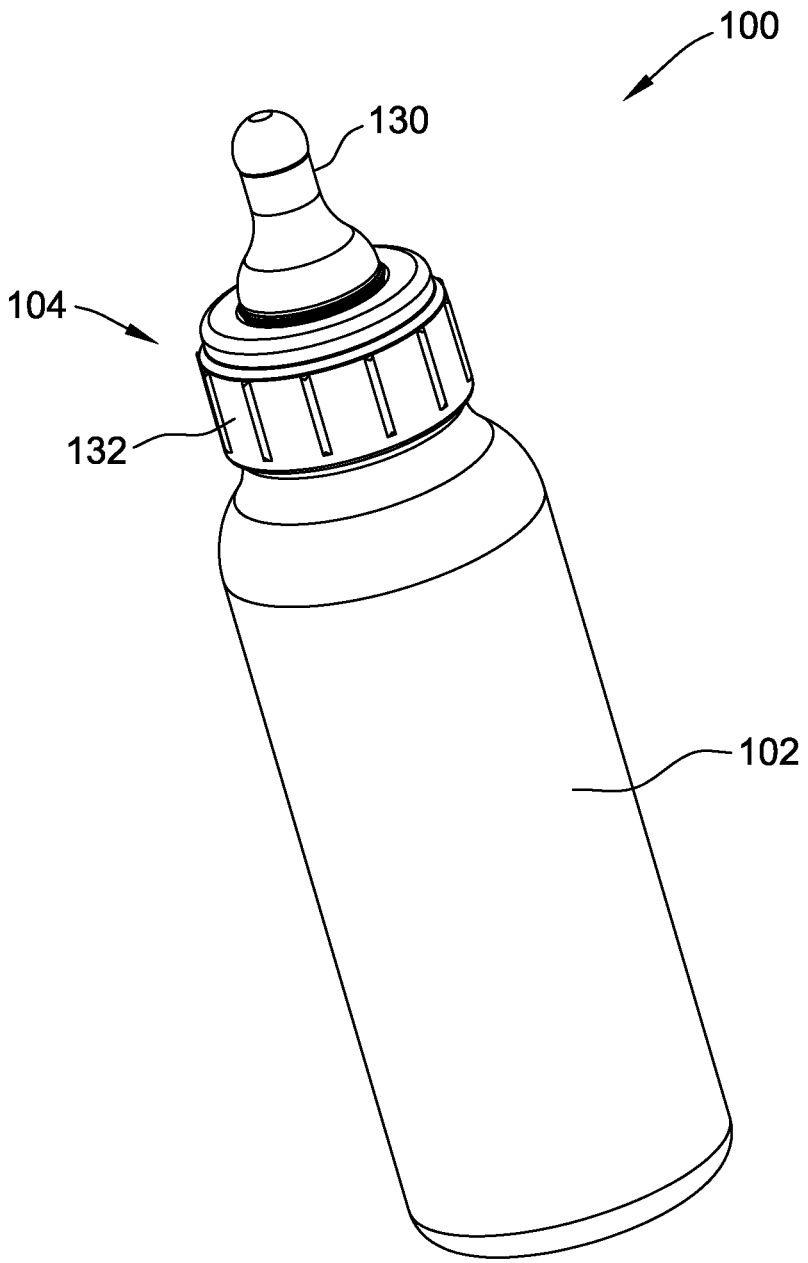
FIG. 1 is a perspective of one embodiment of a nursing bottle assembly.

Referring now to the drawings and in particular to FIGS. 1-6, a bottle assembly, generally indicated at 100, includes a container 102 such as a bottle and more particularly a nursing bottle in the illustrated embodiment, and a collar assembly, generally indicated at 104, for generally closing the bottle. The container 102 is generally cylindrical and symmetric about a central axis, and includes a liquid chamber 106 defined therein and adapted to hold a quantity of liquid for consumption by a user, such as a nursing infant. It is also understood that the container 102 may be configured other than as illustrated herein, and may be configured for use other than as a nursing bottle assembly, such as a sports bottle, a drink tumbler, a training cup, a commuter cup, etc. The container 102 may be made of any suitable material such as, without limitation, glass, polypropylene or other plastic, aluminum, or stainless steel. The container 102 can also be made in any desired color or colors, and may be transparent, translucent, or opaque.

Figure 2:
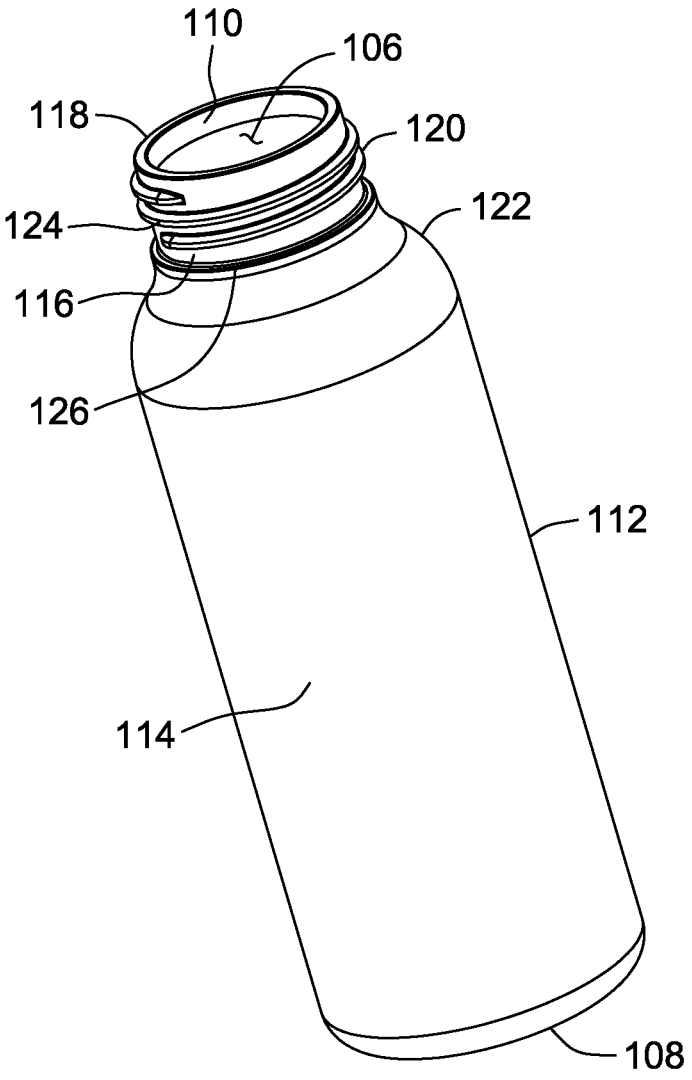
FIG. 2 is a perspective of a container of the nursing bottle assembly of FIG. 1.

The container 102, as most readily seen in FIG. 2, has a closed bottom 108, an open top 110, and a generally cylindrical side wall 112 extending between the closed bottom 108 and the open top 110. The cylindrical side wall 112 includes a base portion 114 and a neck 116 that is narrowed with respect to the base portion 114. That is, the neck 116 has a smaller diameter than the base portion 114. The neck 116 includes an annular rim 118, an externally threaded portion 120, and a lip 126 extending around the circumference of the neck 116. When assembled, the lip 126 may be located proximate a bottom edge 151 of a collar 132 (to be discussed more fully). The container 102 further comprises a shoulder 122 defined at the transition between the neck 116 and the base portion 114. The threaded portion 120 of the neck 116 includes threads 124 for assembling the container 102 to the collar assembly 104 as described later herein.

The collar assembly 104 of the bottle 100 is adapted for removable attachment to the container 102 for selectively holding a nipple 130 on the container 102. The illustrated collar assembly 104 includes the nipple 130 and a collar 132. The nipple 130 and the collar 132 can each be made of any suitable material. In one embodiment, for example, the nipple 130 is made of a substantially pliable material such as at least one of a rubber material, a silicone material, and a latex material, and the collar 132 is made of polypropylene. The nipple 130 and the collar 132 can be made in any desired color or colors, and may be transparent, translucent, or opaque.

Figure 3A:
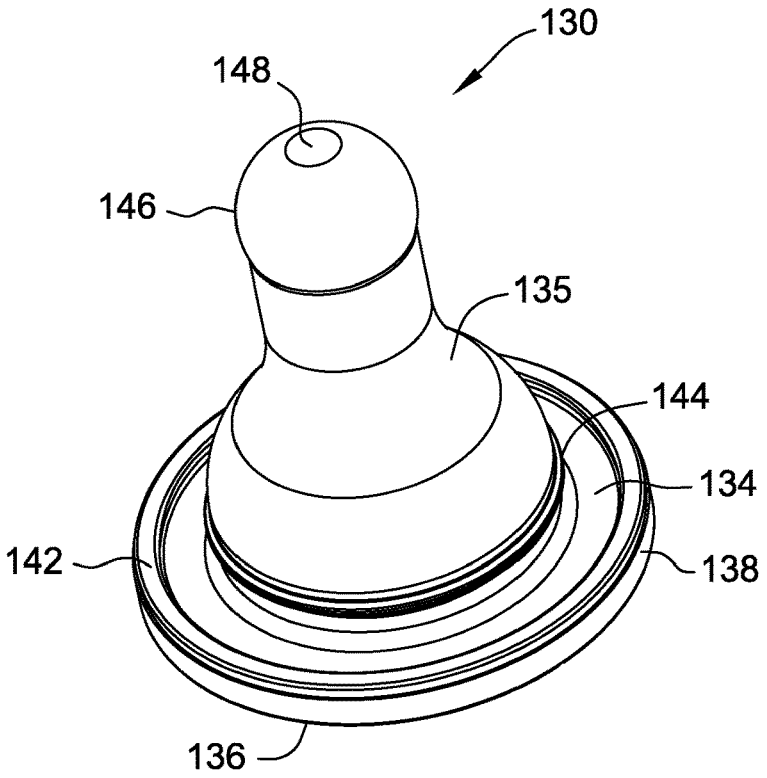
FIGS. 3A and 3B are perspectives of a nipple of the nursing bottle assembly of FIG. 1.
Figure 3B:
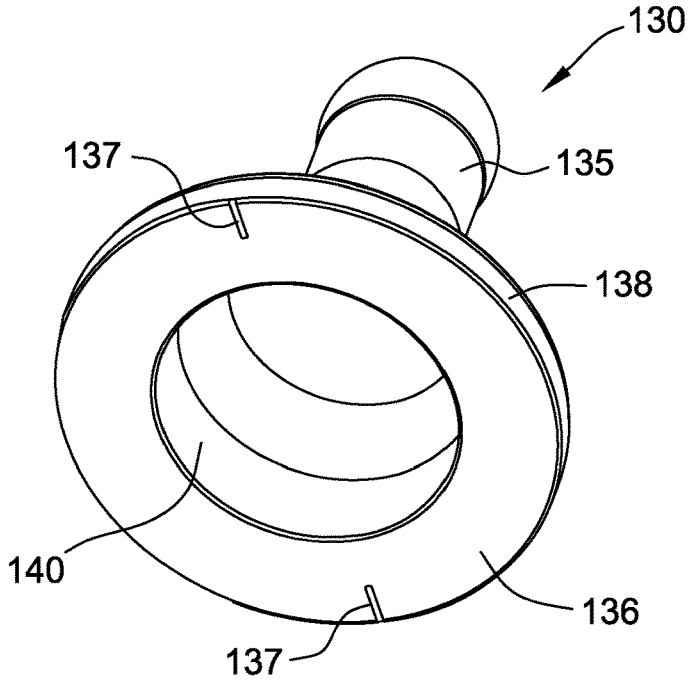

As best seen in FIGS. 3A and 3B, the nipple 130 includes a nipple portion 135 and a transversely extending flange 134. The nipple flange 134 includes a bottom face 136 that extends from a generally circular outer edge 138 to a generally circular inner edge 140. In the illustrated embodiment, a peripherally extending lip 142 projects up from the flange 134 generally adjacent the circular outer edge 138. In at least some alternative embodiments, the nipple 130 does not include a peripherally extending lip 142. The nipple portion 135 extends up from the flange 134 generally adjacent the circular inner edge 140 thereof. In some embodiments, the nipple portion 135 includes an annular projection 144 that projects radially outward. The nipple portion 135 also includes an outlet end 146 including an aperture 148 for dispensing liquid to the user. In some embodiments, the nipple 130 may include one or more radially extending grooves 137 provided on the bottom face 136 of the nipple flange 134. The one or more grooves 137 may facilitate venting of the bottle assembly 100 when the bottle assembly 100 is used without the vent assembly 180, as will be more fully discussed. It is contemplated, however, that the nipple 130 can have different shapes and sizes than those illustrated and described herein without departing from the present invention.

Figure 4:
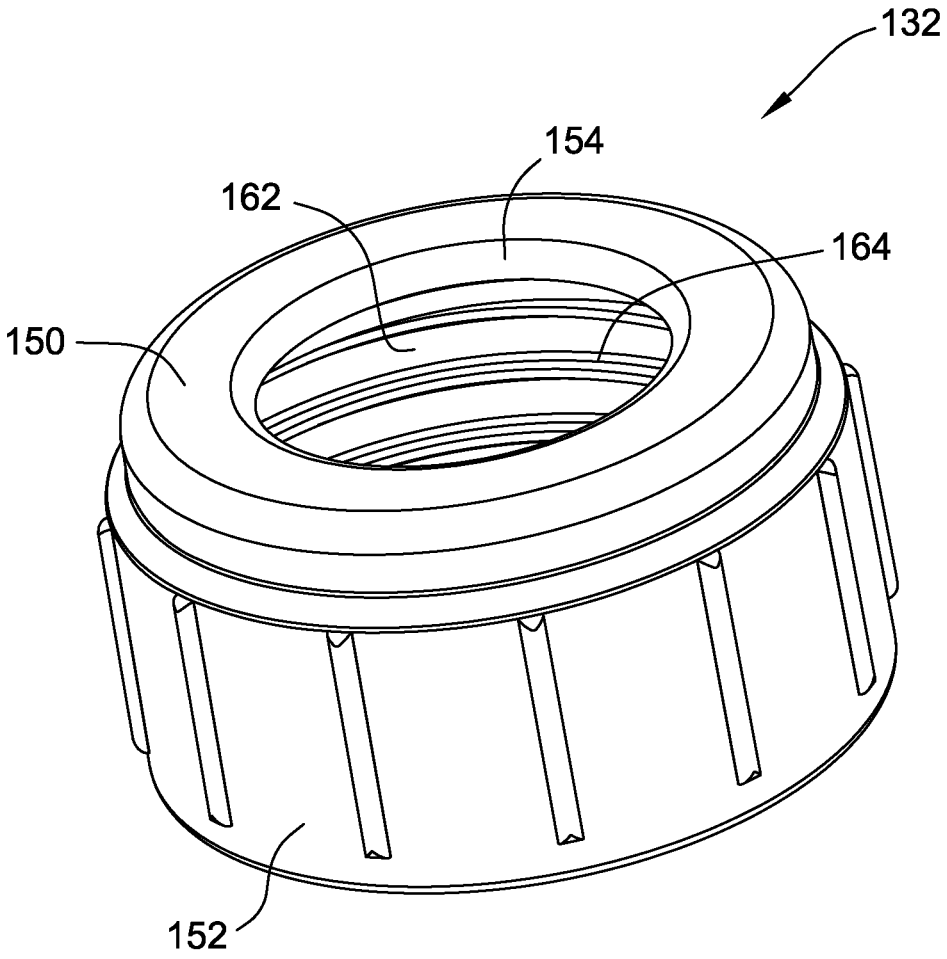
FIG. 4 is a perspective of a collar of the nursing bottle assembly of FIG. 1.
Figure 8:
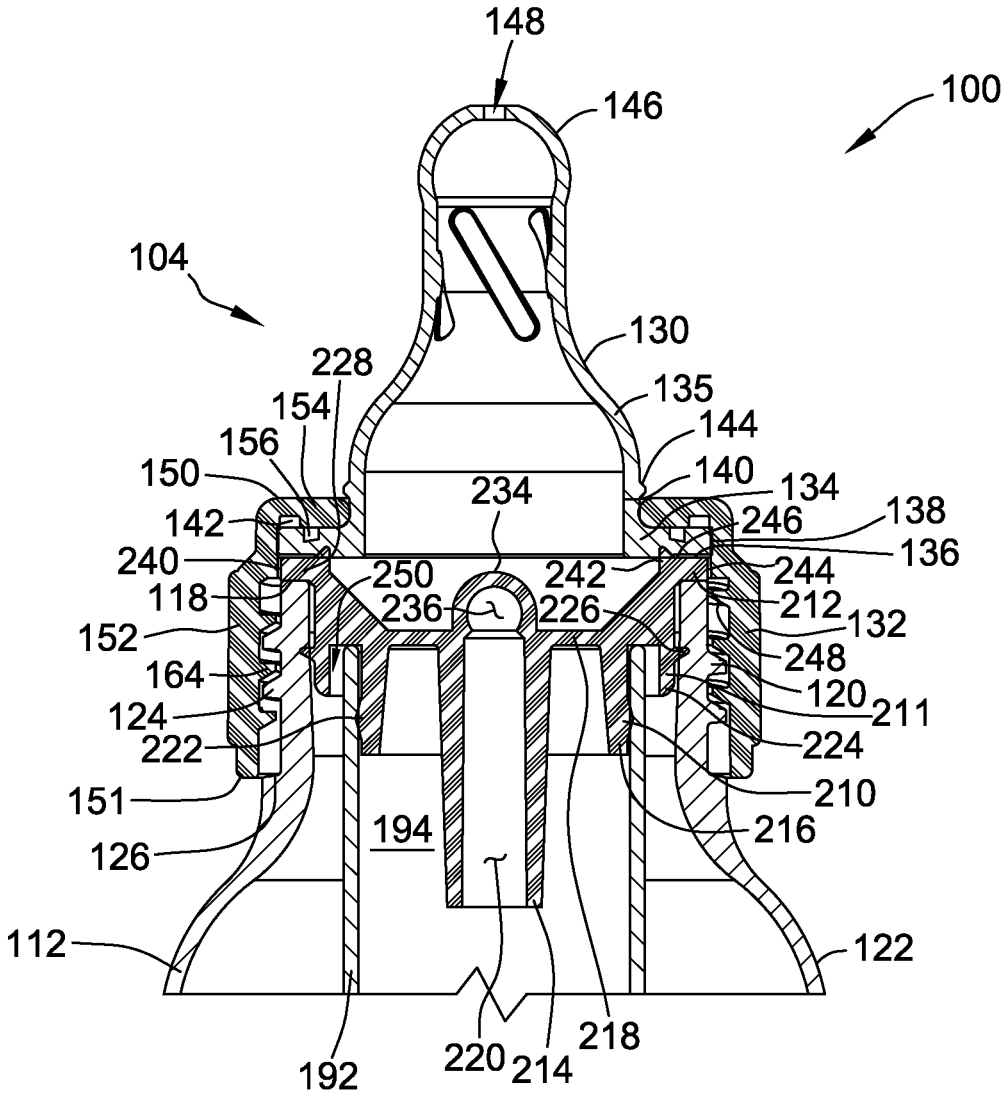
FIG. 8 is an enlarged cross-section of a portion of the nursing bottle assembly of FIG. 1 including the vent assembly.

As best seen in FIG. 4, the illustrated collar 132 has an annular top panel 150 and a depending side wall 152. The top panel 150 includes an annular projection 156 (as seen in FIG. 8) that extends downward from the underside of the panel proximate a radially inner edge margin 154 of the top panel 150. The edge margin 154 and the annular projection 156 facilitate assembly of the nipple 130 on the collar 132. To assemble the collar assembly 104, the nipple 130 is pulled, nipple portion 135 first, up through the central opening in the top panel 150 of the collar 132 until edge margin 154 is positioned below the annular projection 144 of the nipple 130, and the annular projection 156 of the collar 132 is positioned radially inward of the peripheral lip 142 of the nipple 130. It is understood, however, that the nipple 130 and collar 132 may be configured other than as illustrated and still otherwise configured for assembly together for further assembly onto the container 102. It is also contemplated that in other embodiments the nipple 130 and collar 132 need not be capable of being held in assembly for conjoint assembly onto the container 102.

The side wall 152 of the collar 132 has an inner surface 162 with suitable internal threads 164 for threaded engagement with the external threads 124 of the neck 116 of the container 102 to releasably secure the collar 132 and hence the collar assembly 104 on the container 102.

Figure 9:
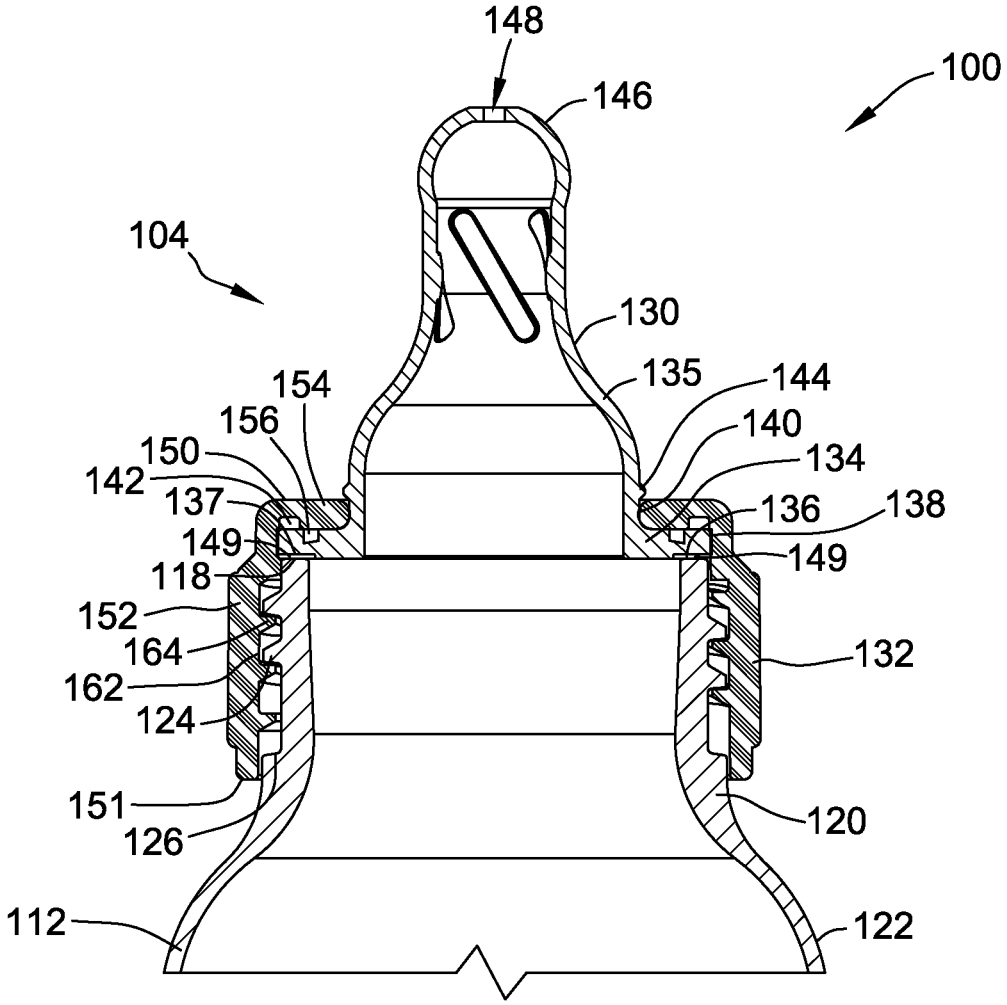
FIG. 9 is an enlarged cross-section of a portion of the nursing bottle assembly of FIG. 1 with the vent assembly omitted.

As best seen in FIGS. 5A-8, the bottle assembly 100 also includes a vent assembly 180 to permit venting of the bottle assembly during use. In FIG. 9, the vent assembly 180 is omitted. The vent assembly 180 includes a vent insert 182 and a receptacle portion 184. The receptacle portion 184 is releasably attachable to the vent insert 182, such as by friction fit in a manner known in the art. The receptacle portion 184 includes a top 186, a middle portion 188, and a vent tube 190. The top 186 includes a generally cylindrical side wall 192 that defines a reservoir 194 therein. The vent tube 190 includes a generally cylindrical side wall 196 that has a smaller diameter than the side wall 192 of the top 186. The side wall 196 of the vent tube 190 defines a passage 198 that is in fluid communication with the reservoir 194. The middle portion 188 includes a tapered side wall 200 that extends between the vent tube side wall 196 and the top side wall 192. The vent tube 190 also includes an air outlet 202 at an end of the passage 198 proximate the closed bottom 108 of the container 102. The air outlet 202 may comprise one or more notches 204 to assist the flow of air and/or fluid from within the passage 198 to the liquid chamber 106 of the container 102.

Figure 5A:
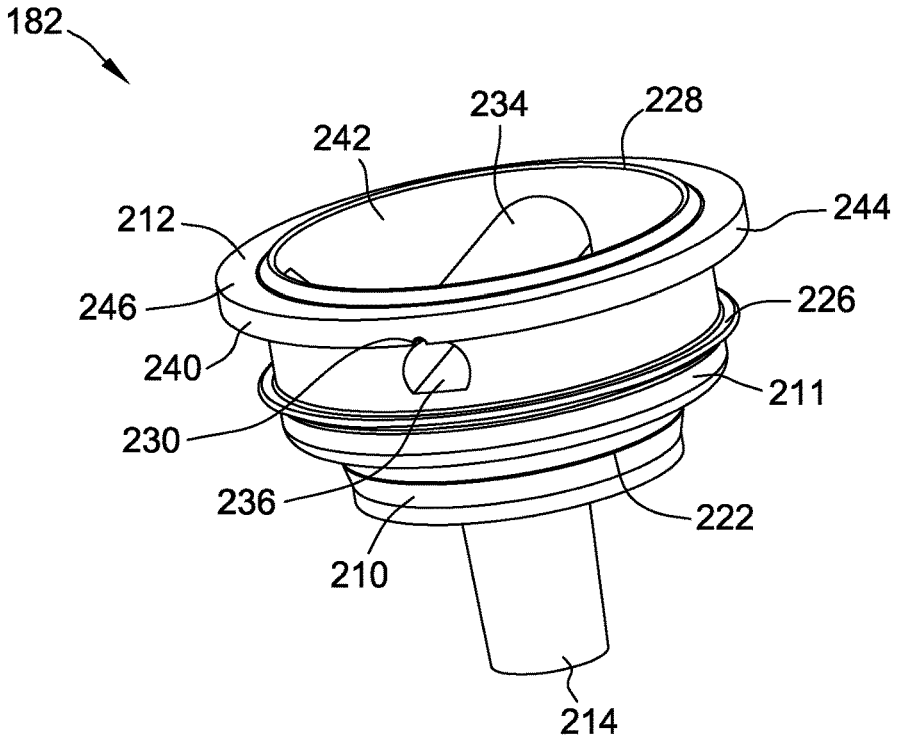
FIGS. 5A and 5B are perspectives of a vent insert of the nursing bottle assembly of FIG. 1.
Figure 5B:
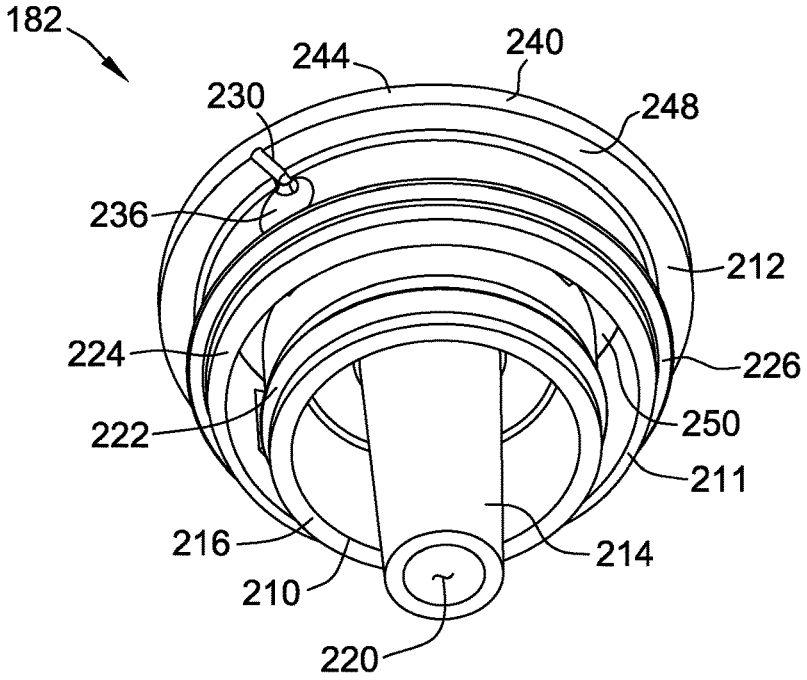
Figure 6:
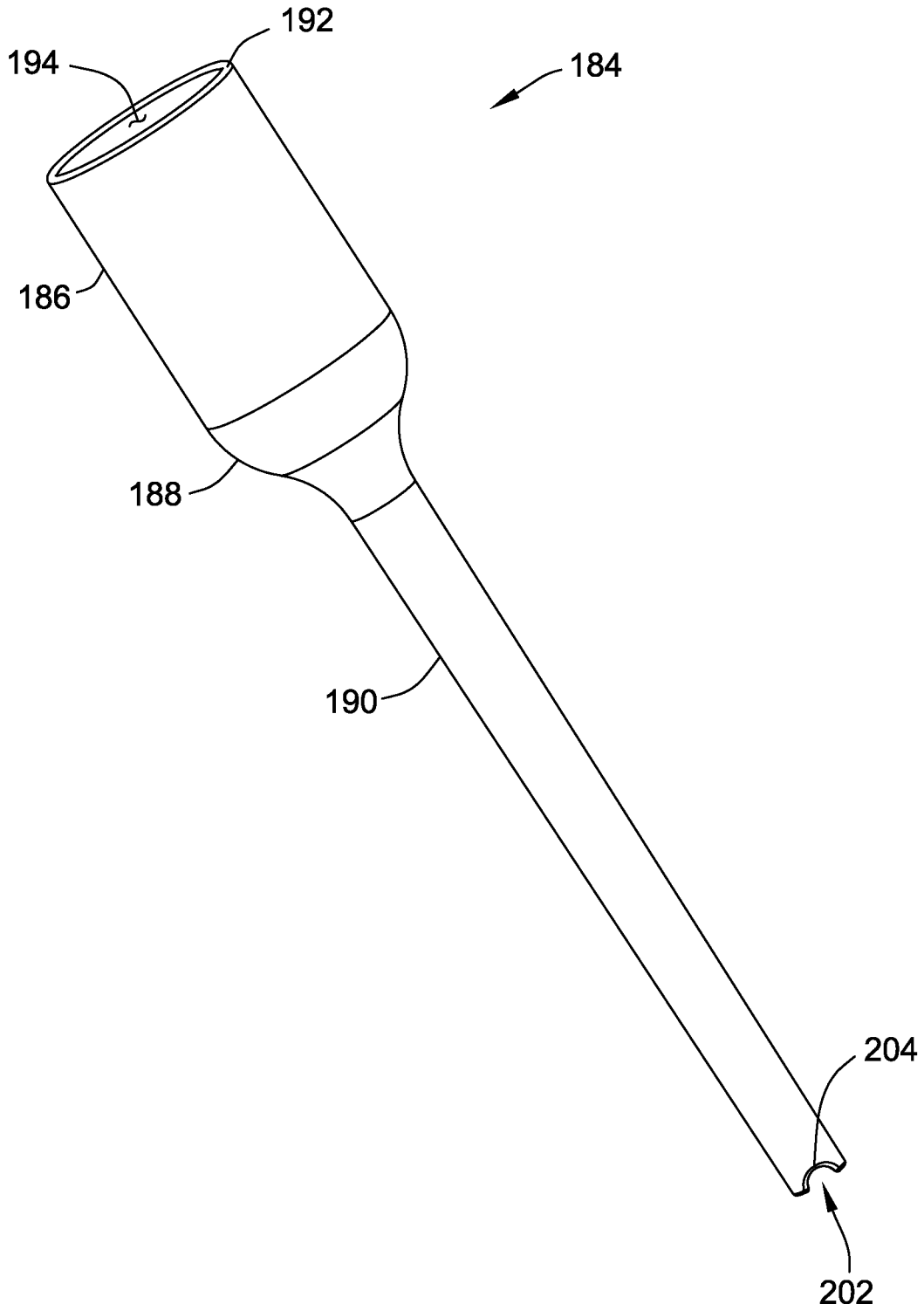
FIG. 6 is a perspective of a receptacle portion of a vent assembly of the nursing bottle assembly of FIG. 1.
Figure 7:
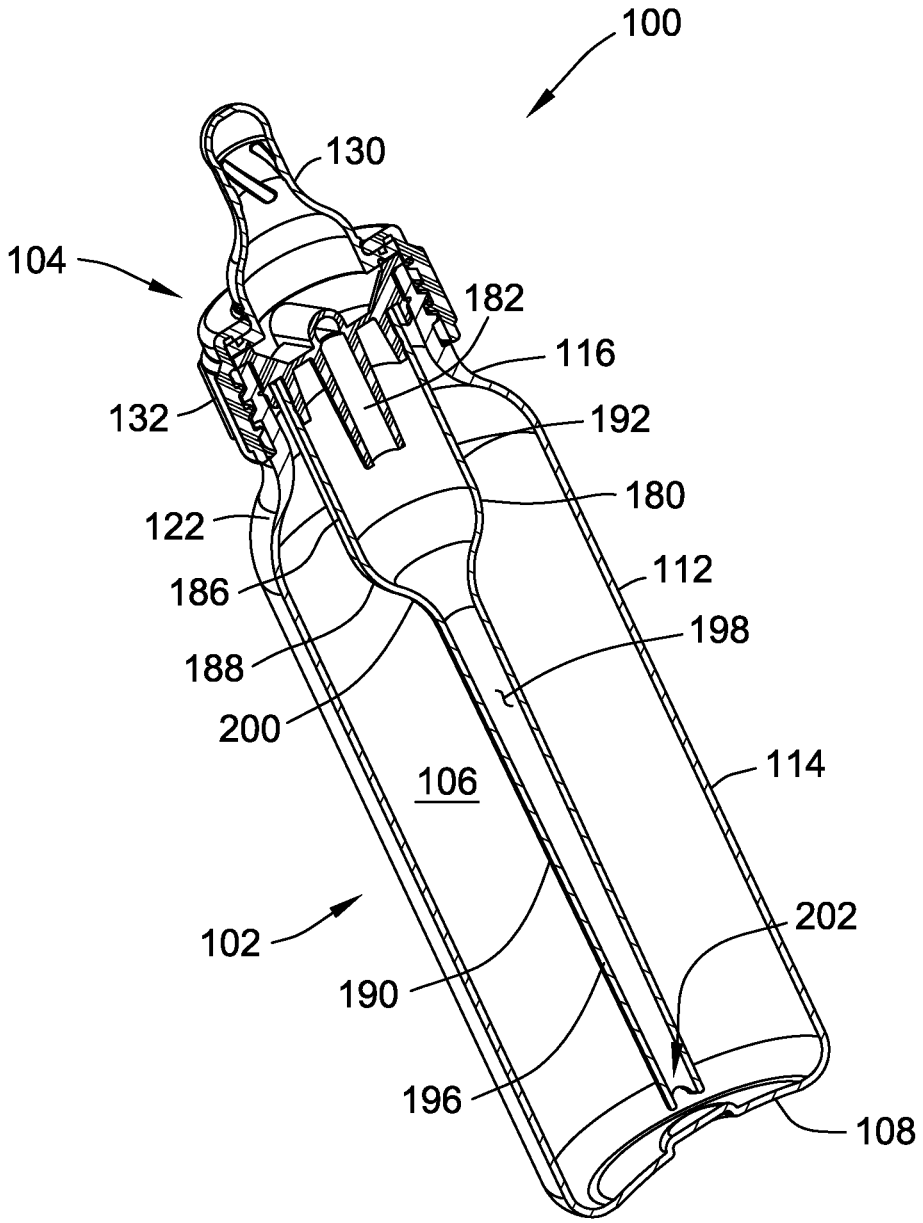
FIG. 7 is a perspective cross-section of the nursing bottle assembly of FIG. 1 including the vent assembly.

As best seen in FIGS. 5A-5B and 8, the vent insert 182 includes an inner portion 210, an intermediate portion 211, and an outer portion 212. The inner portion 210 includes an internal vent tube 214, a lip 216, and a top wall 218 extending between and oriented normal to the internal vent tube 214 and lip 216. The internal vent tube 214 defines a passage 220 in flow communication with the reservoir 194. To assemble the vent insert 182 to the receptacle portion 184, the lip 216 is configured to engage the side wall 192 of the receptacle portion 184. For example, in one embodiment, the lip 216 includes a bulge 222 that engages the side wall 192. Alternatively, the vent insert 182 and the receptacle portion 184 may be integrally formed with each other. The inner portion 210 of the vent insert 182 further includes a lateral vent 234 extending upward from the top wall 218 to define a channel 236 within the vent insert 182.

The intermediate portion 211 of the vent insert 182 is positioned radially between the inner portion 210 and the outer portion 212 with respect to a center of the vent insert 182. The intermediate portion 211 includes a container engaging lip 224 configured to abut an inner surface of the side wall 112 of the container 102, with a container engaging bulge 226 disposed on the container engaging lip 224. The container engaging bulge 226 may frictionally engage the inner surface of the side wall 112 of the container 102 (more particularly, an inner surface of the neck 116 of the container 102) when the vent assembly 180 is seated on container 102. A gap 250 defined between the side wall 192 of the receptacle portion 184 and the container engaging lip 224 enables liquid in the liquid chamber 106 to flow towards the nipple 130.

The outer portion 212 of the vent insert 182 includes a perimeter wall 240. The perimeter wall 240 includes an inner edge 242, an outer edge 244, a top 246, and a bottom 248. The bottom 248 of the perimeter wall 240 is configured to sit on the annular rim 118 of the container 102 when the bottle assembly 100 is assembled, as best seen in FIG. 8. The outer portion 212 may further comprise an annular rib 228 projecting from the top 246 of the perimeter wall 240. The annular rib 228 may serve to compress and/or deform the flange 134 of the nipple 130 when the collar assembly 104 is attached to the container 102 in order to reduce leakage during use of the bottle assembly 100. The annular rib 228 may also sealingly engage the bottom face 136 of the nipple 130 in a configuration in which the bottle assembly 180 includes the vent assembly 180. Outer portion 212 may further comprise one or more radially extending grooves 230 provided on the bottom 248 of the perimeter wall 240 which are in fluid communication with the channel 236 of the lateral vent 234. In such embodiments, the one or more grooves 230 space a portion of the vent insert 182 apart from the rim 118 of the container 102 to allow air to flow to the lateral vent 234 when the outer portion 212 is pressed against the rim 118. Thus, the lateral vent 236 will be in fluid communication with an exterior of the bottle assembly 100 via the one or more grooves 230 when the bottle assembly 100 includes the vent assembly 180 such that the container 102 can vent during use of the bottle assembly 100.

Although the vent assembly 180 depicted in the figures has been described in detail, it is contemplated that the components of the vent assembly 180 can have different shapes and sizes than those illustrated and described herein without departing from some aspects of this disclosure. Similar vent assemblies are known in the art, such as those used on the bottle assemblies disclosed in U.S. Pat. No. 5,779,071 issued Jul. 14, 1998, U.S. Pat. No. 7,828,165 issued Nov. 9, 2010, U.S. Pat. No. 8,113,365 issued Feb. 14, 2012, and U.S. Pat. No. 8,146,759 issued Apr. 3, 2012. Accordingly, additional details and operation of the vent assembly 180 is not described further herein.

As best illustrated in FIGS. 8 and 9, the collar sidewall 152, the outer portion 212 of the vent insert 182, and the container neck 116 are suitably sized relative to each other to permit operation of the bottle assembly 100 in two different configurations: a first configuration (as seen in FIG. 8) in which the vent assembly 180 is included and a second configuration (as seen in FIG. 9) in which the vent assembly 180 is omitted. For example, the length (or height in the orientation of the drawings herein) of the container neck 116 (e.g., from the rim 118 of the container 102 to the lip 126 and/or to the shoulder 122 where the neck 116 widens outward to the base portion 114 of the container 102) is sufficient to accommodate the side wall 152 of the collar 132 in the second configuration; i.e., when the vent assembly is omitted as illustrated in FIG. 9. More particularly, when the vent assembly 180 is omitted, the collar 132 is configured to tighten down an additional vertical distance approximately equal to a height of the perimeter wall 240 of the outer portion 212 of the vent insert 182 such that the bottom face 136 of the nipple 130 seats on the annular rim 118 of the container 102. In such an embodiment, because the collar 132 is configured to tighten down the additional vertical distance, the collar 132 can securely seat the nipple 130 to the annular rim 118 in order to minimize or even eliminate leakage of liquid from the bottle assembly 100 when used without the vent assembly 180.

This may be more readily understood with reference to FIGS. 5A-5B and 8. As illustrated, the vent insert 182 is constructed such that the height of the outer portion 212 (more specifically, the height of the perimeter wall 240) is relatively narrow compared to the rest of the vent insert 182. This is achieved by, among other features, providing the channel 236 of the lateral vent 234 below the outer portion 212 such that the channel 236 (or, alternatively, a majority of the channel 236) ultimately sits below the annular rim 118 of the container 102 when the vent insert 182 is in the assembled position (as depicted in FIG. 8). Accordingly, the height of the perimeter wall 240 of the outer portion 212 may be narrower than otherwise would be necessary to accommodate the channel 236 of the lateral vent 234 if the channel 236 was provided above the annular rim 118 of the container 102 when assembled (as is common for many known vent assemblies). Rather, the perimeter wall 240 of the vent insert 182 must only be tall enough to accommodate the one or more grooves 230, which is in fluid communication with the channel 236 of the lateral vent 234.

Such relative dimensions of the vent insert (i.e., the narrowness of the perimeter wall 240 relative to the other features of vent insert 182) allows the bottle assembly 100 to be assembled in two configurations while minimizing leakage from the bottle assembly 100 in each configuration. For example, and as best seen in FIG. 8, in a first configuration, the bottle assembly 100 includes the vent assembly 180. In this configuration, the vent assembly 180 is inserted into the container 102 such that the bottom 248 of the perimeter wall 240 of the vent insert 182 seats down against the rim 118 of the container 102, and such that the container engaging lip 224 (or more particularly the container engaging bulge 226) frictionally engages an inner surface of the side wall 112 of the container 102. After the vent assembly 180 is inserted in such a position, the collar assembly 104 is attached to the container 102 by threadably engaging the internal collar threads 164 with the external threads 124 of the neck 116 and rotating the collar 132 to twist the collar down onto the container 102. As the collar 132 is tightened onto the container 102, the bottom face 136 of the nipple 130 is urged against the top 246 of the perimeter wall 240 and against the annular rib 228 of the vent insert 182 to seal the nipple 130 (and hence the collar assembly 104) against the vent assembly 180. Concurrently, the bottom 248 of the perimeter wall 240 of the vent insert 182 is urged against the rim 118 of the container 102 to position the vent assembly 180 on the container 102.

In this configuration, the collar threads 164 engage the threads 124 of the neck such that no threads are visible below the collar 132. More particularly, and as best illustrated in FIG. 8, the collar side wall 152 is sufficiently long such that in the first configuration the bottom edge 151 of the collar side wall 152 extends below the lowermost external thread 124 of the neck 116 so that no external threads 124 are visible when the collar assembly 104 is secured to the container 102. Further, because the collar assembly 104 securely seats the nipple 130 and the vent assembly 180 to the rim 118 of the container 102, leakage is minimized during use of the bottle assembly 100.

Further, in embodiments where the nipple 130 includes one or more radially extending grooves 137 on the bottom face 136 of the flange 134, the annular rib 228 provided on the vent insert 182 may serve as a seal between the one or more grooves 137 and the liquid chamber 106 of the container 102 such that the one or more grooves 137 are not in fluid communication with the liquid chamber 106 when the bottle assembly 100 is in the first configuration. More particularly, and returning to FIG. 3B, the one or more grooves 137 provided on the bottom face 136 of the nipple flange 134 may extend only partially in from the outer edge 138 of the nipple 130 (i.e., the one or more grooves 137 may not extend all the way to an inner edge 140 of the nipple 130). Further, the annular rib 228 of the vent insert 182 may be disposed (when the bottle assembly 100 is assembled in the first configuration) radially inward from the innermost portion of the one or more grooves 137. In such an embodiment, because the annular rib 228 is disposed radially inward from the innermost portion of the one or more grooves 137, the annular rib 228 may seal the liquid chamber 106 of the container 102 from the one or more grooves 137, such that the one or more grooves 137 are not in fluid communication with the liquid chamber 106 when the bottle assembly 100 is in the first configuration. In such embodiments, venting of the container 102 during use may be accomplished via the vent assembly 180, and, more particularly, via the one or more grooves 230 and the lateral vent 234 of the vent insert 182.

In a second configuration, as illustrated in FIG. 9, the vent assembly 180 is omitted from the bottle assembly 100. In such a configuration, when the collar assembly 104 is tightened down onto the container 102, the collar threads 164 engage the threads 124 of the neck 116 of the container 102 and the collar 132 is rotated to twist the collar 132 down onto the container 102 until the nipple 130 is urged against the rim 118 of the container 102 to seal the nipple 130 directly against the container 102. Accordingly, the collar assembly 104 will ultimately be twisted a greater distance than in the first configuration before it is fully seated on the container 102. That is, because the vent assembly 180 (and accordingly the vent insert 182) is omitted from the bottle assembly 100 in this configuration, the collar assembly 104 will need to be tightened down an additional vertical distance approximately equal to the height of perimeter wall 240 of the omitted vent inset 182. However, because the vent insert 182 is constructed as described (e.g., because the channel 236 of the lateral vent 234 is disposed below the outer portion 212 of the vent insert 182), the perimeter wall 240 is relatively narrow and thus the collar 132 does not require much additional tightening than when the vent assembly 180 is included (as depicted in FIG. 8). Accordingly, in the second configuration, the collar assembly 104 can be fully tightened (i.e., fully assembled such that the nipple 130 securely engages the container 102) before the side wall 152 of the collar 132 engages with the lip 126 and/or the shoulder 122.

The one or more grooves 137 included on the bottom face 136 of the nipple 130 may be configured to vent the container 102 when the bottle assembly 100 is in the second configuration even though the vent assembly 180 is omitted. More particularly, and as best seen in FIG. 9, the one or more grooves 137 space a portion of the nipple 130 apart from the rim 118 of the container 102 forming vent spacing 149 which is in fluid communication with the liquid chamber 106 of the container 102. Thus, when the bottle assembly 100 is assembled in the second configuration (i.e., when the bottle assembly 100 is used with the vent assembly 180 omitted with the nipple 130 pressed against the rim 118), the bottle assembly 100 may nonetheless vent through the vent spacing 149 provided between the one or more grooves 137 and the rim 118 of the container. Thus, even in the second configuration, the formation of a vacuum within the bottle assembly 100 can be reduced or eliminated, as air may fluidly enter the bottle assembly via vent spacing 149.

The components as described herein may provide additional benefits for users of existing bottle assemblies and/or existing vent assemblies. For example, many current users may already own several containers 102 configured to operate with one or more of the known collar assemblies and/or vent assemblies. These containers may comprise, e.g., a lip 126 and/or external threads 124 configured to be used with a known collar assembly and/or a known vent assembly. However, because the perimeter wall 240 of the vent insert 182 is constructed as described herein (i.e., the perimeter wall 240 is relatively narrow as compared to prior art vent insert) the side wall 152 of the collar 132 may be constructed narrower than, e.g., known collars, while still covering the external threads 124 of the container 102 when assembled with the vent assembly 180 (as discussed). Accordingly, a user may be able to use the collar assembly 104 and/or the vent assembly 180 described herein with their currently owned containers 102, whereas the lip 126 and/or shoulder 122 would otherwise interfere with a known collar (thus leading to leakage) should the known vent assembly be omitted. Further, because some embodiments of the collar assembly 104 of the instant disclosure (and more particularly some embodiments of the nipple 130 of the instant disclosure) include one or more grooves 137 which provide the vent spacing 149 when the bottle assembly 100 is in the second configuration, the container 102 may be vented during use even if the vent assembly 180 is omitted. Thus, some embodiments of the instant disclosure reduce or eliminate the formation of a vacuum within the bottle assembly 100 during use even if the vent assembly 180 is omitted. Still further, a manufacturer or the like of the containers 102 may continue to manufacture the containers 102 using a same design as for known bottle assemblies, while providing the bottle assemblies 100 with the novel collar assembly 104 and/or vent assembly 180 described herein such that the improved bottle assembly 100 reduces or eliminates leakage during use of the bottle assembly 100 either in either discussed configuration.

When introducing elements of the present invention or the various versions, embodiment(s) or aspects thereof, the articles "a", "an", "the" and "said" are intended to mean that there are one or more of the elements. The terms "comprising", "including" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above without departing from the scope of the invention, it is intended that all matter contained in the above description and shown in the accompanying drawings shall be interpreted as illustrative and not in a limiting sense.

What is claimed is:

1. A bottle assembly comprising:

a container comprising an open end, a closed end, a base portion, a neck, and a rim on the neck of the container and defining the open end of the container, the container having a central axis;

a vent assembly positionable at least in part on the rim of the container to permit venting of the container during use and comprising at least one lateral vent extending other than parallel to the central axis of the container when the vent assembly is positioned on the rim of the container, the vent assembly further comprising an inner portion including a vent tube and a top wall oriented normal to the vent tube, the lateral vent extending upward from the top wall; and a collar assembly generally defining a closure for the container and being releasably engageable with the neck of the container over the open end thereof, the collar assembly and vent assembly being configured relative to each other to permit selective configuration of the bottle assembly between:

a first configuration in which upon releasable engagement of the collar assembly with the neck of the container when the vent assembly is on the rim of the container, the collar assembly urges the vent assembly into substantially sealing engagement with the rim of the container such that at least a majority of a cross-section of the lateral vent is disposed below the rim; and a second configuration in which upon releasable engagement of the collar assembly with the neck of the container when the vent assembly is omitted from the bottle assembly, the collar assembly substantially sealingly engages the rim of the container.

2. The bottle assembly set forth in claim 1, wherein the vent assembly further comprises an outer portion, wherein, when the vent assembly is positioned on the rim of the container, a bottom of the outer portion rests on the rim of the container.

3. The bottle assembly set forth in claim 2, wherein the bottom of the outer portion comprises at least one groove in fluid communication with the lateral vent.

4. The bottle assembly set forth in claim 3, wherein the at least one groove spaces a portion of the vent assembly apart from the rim of the container when the vent assembly is positioned on the rim of the container in order to permit air to flow to the lateral vent during use.

5. The bottle assembly set forth in claim 2, wherein the vent assembly further comprises an annular rib disposed on a top of the outer portion.

6. The bottle assembly set forth in claim 5, wherein, when the bottle assembly is in the first configuration, the annular rib sealingly engages the collar assembly.

7. The bottle assembly set forth in claim 1, wherein the container further comprises a lip extending around a circumference of the neck.

8. The bottle assembly set forth in claim 7, wherein a bottom edge of the collar assembly is disposed above the lip when the bottle assembly is in both the first configuration and the second configuration.

9. A single-piece vent insert for a bottle assembly, the bottle assembly including a container having a rim, the vent insert comprising:

an annular outer portion having a central axis and a bottom, the bottom of the annular outer portion being positionable on the rim of the container;

an inner portion including a vent tube and a top wall oriented normal to the vent tube: and a lateral vent extending upward from the top wall and other than parallel to the central axis of the annular outer portion, the lateral vent disposed at least in part below the bottom of the annular outer portion.

10. The vent insert set forth in claim 9, wherein the bottom of the annular outer portion comprises at least one groove formed separate from and in fluid communication with the lateral vent.

11. The vent insert set forth in claim 9 further comprising an annular rib disposed on a top of the annular outer portion.

12. The vent insert set forth in claim 11, wherein the annular rib is configured to sealingly engage a collar assembly when the collar assembly is releasbly engaged with a neck of the container with the bottom of the annular outer portion positioned on the rim of the container.

13. The vent insert set forth in claim 9 further comprising an intermediate portion configured to sealingly engage an inner surface of the container when bottom of the annular outer portion is positioned on the rim of the container.

14. A bottle assembly comprising:

a container comprising an open end, a closed end, a neck, and a rim on the neck defining the open end of the container;

a vent assembly positionable at least in part on the rim of the container to permit venting of the container during use, the vent assembly comprising a lateral vent and an inner portion including a vent tube and a top wall oriented normal to the vent tube, the lateral vent extending upward from the top wall; and a collar assembly generally defining a closure for the container and being releasably engageable with the neck of the container over the open end thereof, the collar assembly and vent assembly being configured relative to each other to permit selective configuration of the bottle assembly between:

a first configuration in which upon releasable engagement of the collar assembly with the neck of the container when the vent assembly is on the rim of the container, the collar assembly urges the vent assembly into substantially sealing engagement with the rim of the container; and a second configuration in which upon releasable engagement of the collar assembly with the neck of the container when the vent assembly is omitted from the bottle assembly, the collar assembly substantially sealingly engages the rim of the container, wherein the container is vented via the vent assembly in the first configuration, and wherein the container is vented via the collar assembly in the second configuration.

15. The bottle assembly set forth in claim 14, wherein the container is vented via the vent assembly in the first configuration, and wherein the container is vented via the collar assembly in the second configuration.

16. The bottle assembly set forth in claim 14, wherein the collar assembly comprises a nipple which substantially sealingly engages the rim of the container in the second configuration.

17. The bottle assembly set forth in claim 16, wherein the nipple comprises at least one groove disposed on a bottom face of the nipple, wherein, when the bottle assembly is in the second configuration, the at least one groove spaces a portion of the nipple apart from the rim to form a vent spacing through which the container is vented.

18. The bottle assembly set forth in claim 17, wherein the vent assembly comprises an annular rib configured to seal the at least one groove when the bottle assembly is in the first configuration such that the one or more grooves is not in fluid communication with a liquid chamber of the container when the bottle assembly is in the first configuration.

* * * * *